United States Patent [19]

Irwin

[11] Patent Number: 4,611,360

[45] Date of Patent: Sep. 16, 1986

[54] PIPE CLEANING MACHINE

[76] Inventor: Lawrence F. Irwin, 12860 San Fernando Rd., Sylmar, Calif. 91342

[21] Appl. No.: 671,621

[22] Filed: Nov. 15, 1984

[51] Int. Cl.[4] ..... B08B 9/02

[52] U.S. Cl. ..... 15/104.3 SN

[58] Field of Search ..... 15/104.3 SN, 104.3 R

[56] References Cited

U.S. PATENT DOCUMENTS

| | | | |
|---|---|---|---|
| 2,167,268 | 7/1939 | Sanger | 15/104.3 SN |
| 3,095,592 | 7/1963 | Hunt | 15/104.3 SN |
| 3,958,293 | 5/1976 | Irwin | 15/104.3 SN |

*Primary Examiner*—Edward L. Roberts

*Attorney, Agent, or Firm*—James E. Brunton

[57] ABSTRACT

An improved pipe cleaning machine of the type which uses an elongated, flexible coil spring or plumbers snake formed of helically wound spring wire which is housed within a rotatable, hollow spring storage reel and is withdrawn therefrom for insertion into the pipe to be cleaned. The machine of the present invention embodies a novel one-piece rotatably driven drum or housing having a forward guide portion for guiding the dispensing and retraction of the spring and a partitioning wall which partitions the drum into a first portion in communication with the forward guide portion and a second portion which closely contains the spring in a coiled configuration. The partitioning wall terminates in an end portion which is spaced from the rear wall of the drum a predetermined distance to define a restricted guide passageway communicating with the spring storage compartment. The restricted size of the storage compartment coupled with the restricted size and location of the guide passageway effectively prevents backlooping and tangling of the spring within the storage compartment.

7 Claims, 4 Drawing Figures

PIPE CLEANING MACHINE

BACKGROUND OF THE INVENTION

1. Field of the Invention

This invention relates generally to pipe cleaning machines and more particularly to a power driven machine for storing and rotatively feeding and retracting flexible plumbers snakes or springs formed of helically wound spring wire.

2. Description of the Prior Art

Numerous types of motorized tools have been suggested for use in clearing sewer lines of obstructions. Over the years the construction of these tools has become standardized in many respects. For example, such apparatus typically includes a closed drum, or reel, from which a length of flexible, helically wound spring, known as a plumbers snake, is paid out. After coming off the reel, the spring is guided into a forwardly disposed guide element which is substantially in alignment with the axis of the reel. If the snake is not to be paid out by hand, the guide element is usually provided with means such as rollers, jaws, or the like which engage the snake so that upon rotation of the drum, or reel, rectilinear movement is imparted to the snake. Thus, if the reel is rotated in one direction, the snake is paid out; while if it is rotated in the opposite direction, it is taken in.

In cleaning out a clogged sewer line the free end of the snake is first introduced into the line. next, rotation of the drum in a forward direction is initiated and finally the snake is paid out by hand or the feed means is brought into engagement with the snake so as to feed it into the line. Feeding of the snake is continued until the obstruction is encountered and loosened. However, should the snake encounter a blockage within the line which cannot be loosened, the snake may be caught so that it cannot rotate. In this situation continued rotation of the reel, even for a short period, will cause significant build-up of torque forces on the snake within the drum. If feeding is allowed to continue, these torque forces will cause undesirable back-looping and kinking of the snake within the storage drum or reel. This back-looping in turn causes the snake to become tangled within the drum or reel so that the snake can sometimes neither be paid out or taken in. To rectify this situation the operator must stop the cleanout operation and somehow relieve the torque build-up so that the snake can be untangled. This operation can be both dangerous and time consuming and frequently the operator is simply unable to clear the entanglement sufficiently to continue. It is this problem of torque build-up and back-looping of the snake within the drum which is addressed by the present invention.

In the past, various arrangements have been suggested to eliminate or minimize the torque build-up and back-looping problem inherent in most motorized sewer clean-out tools. One of the most successful of these was made by the present inventor and is described in U.S. Pat. No. 3,958,293. Another proposed solution to the problem is described in U.S. Pat. No. 3,095,592 issued to Robert G. Hunt. The Hunt machine embodied an independently rotatable, combination torque reaction element and guide tube which extended into the storage reel from the front of the machine and cooperated therewith to guide the spring into and out of the storage reel and to prevent kinking thereof due to torque build-up. The apparatus described in the earlier patent issued to the present inventor improved upon the Hunt concept by providing an independently rotatable, uniquely grooved, torque reaction element which extended into the reel and cooperated with the reel to prevent the snake from kinking or back-looping.

The apparatus of the present invention represents a significant improvement over both the Hunt apparatus and the apparatus described in U.S. Pat. No. 3,958,293. As will become apparent from the description which follows, the back-looping and snake tangling problem has been uniquely overcome in the apparatus of the present invention through a novel redesign of the configuration of the storage drum itself. This simple, but highly effective solution to this longstanding problem effectively prevents the tangling of the snake within the drum by controllably guiding the snake into a restricted volume storage portion of the drum through a strategically placed passageway formed by necking down the drum at a location proximate the periphery thereof. With this novel construction, the snake can be smoothly withdrawn from its coiled configuration and, because of the restricted storage volume coupled with the size and location of the passageway leading to the storage volume, the snake is prevented from back-looping and tangling up within the storage area even upon being subjected to substantial torque inducing forces.

SUMMARY OF THE INVENTION

It is an object of the invention to provide a new and substantially simplified power driven pipe cleaning machine of the type which comprises an elongated, flexible coil spring or plumbers snake formed of helically wound spring wire which can be controllably withdrawn from the machine for insertion into the pipe to be cleaned.

It is another object to provide a novel one-piece storage reel or drum which can be fabricated or molded as an integral unit of various rigid materials, in which the coil spring can conveniently be housed. In the preferred form of the invention, the storage reel includes a generally annular shaped, reduced volume, outer portion adapted to closely contain the spring in a coiled configuration. This reduced volume outer portion can be formed in various sizes to accommodate the use of larger or smaller diameter snakes.

It is another object to provide a machine of the aforementioned character in which the storage container or drum embodies a unique coil spring guide means, or passageway, adapted to cooperate with the restricted volume storage portion of the drum to closely constrain the movement of the coil spring within the drum during operation of the machine so as to effectively prevent kinking or reverse looping of the coil spring due to torque build-up.

It is still another object to provide a machine of the type described in the preceding paragraph in which the drum and guide means are so constructed and arranged as to not interfere with the expeditious removal of the drum, thereby enabling a quick-change to another drum, for example, containing a coil spring of a different size.

Another object is to provide a machine of the aforementioned character whch is light-weight, easy and inexpensive to manufacture and yet is extremely durable and reliable.

DESCRIPTION OF ONE FORM OF THE INVENTION

Figure 1:
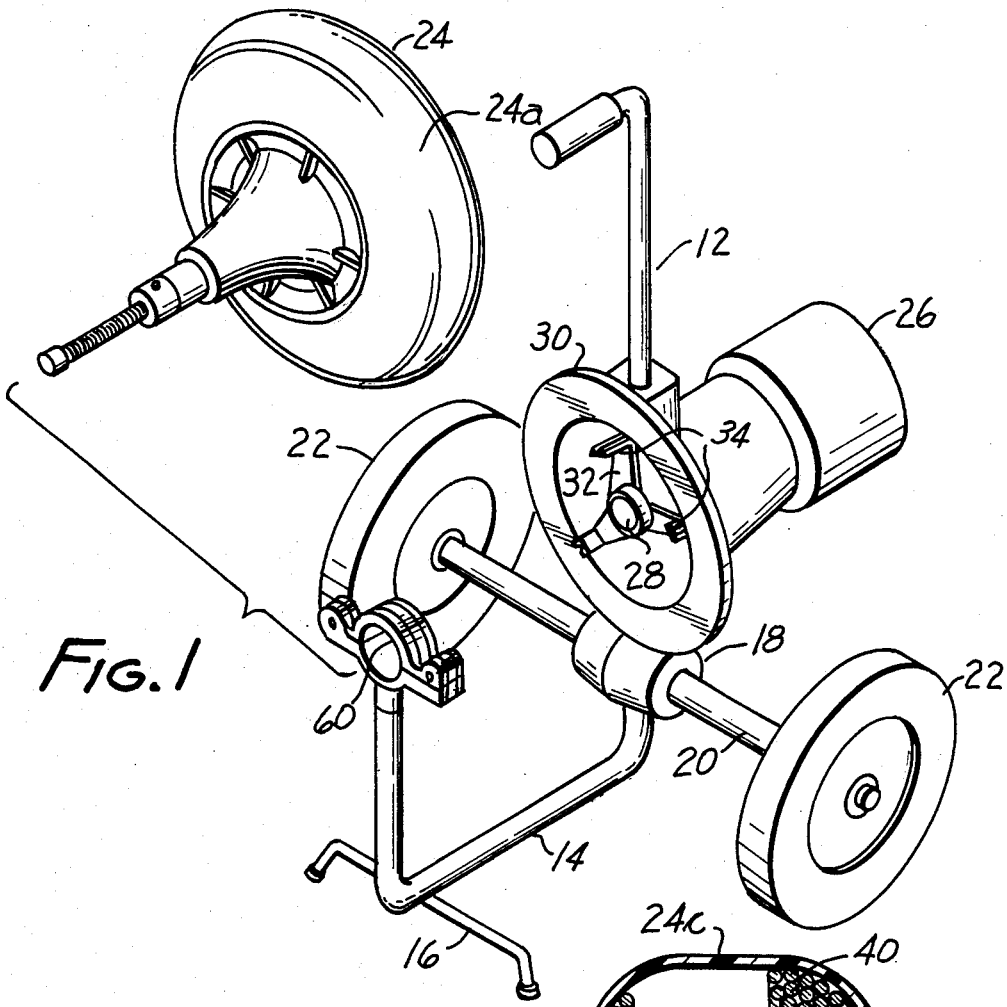
FIG. 1 is an exploded perspective view of the machine of the present invention illustrating the construction of the drum and the manner in which the drum containing the snake can readily be separated from the machine for replacement by another drum and snake assemblage.

Referring to the drawings, the pipe cleaning machine of the present invention includes a frame 12 comprising a generally U-shaped tubular member 14 to which is affixed forward supporting legs 16. Also affixed to member 14 is axle supporting hub 18 adapted to receive an axle 20 which carries wheels 22.

Carried by frame 12 is a one piece rotatable drum 24 and drive means for controllably rotating the drum in a forward and reverse direction. In the present form of the invention the drive means includes an electric motor 26 which is adapted to drive a stub shaft 28. Attached to stub shaft 28 and rotated thereby is a drive assembly 30 which includes a drive member 32 having three forwardly extending drive teeth 34 which are circumferentially spaced by about 120 degrees. In a manner presently to be described drive member 32 rotatably drives drum 24.

Figure 2:
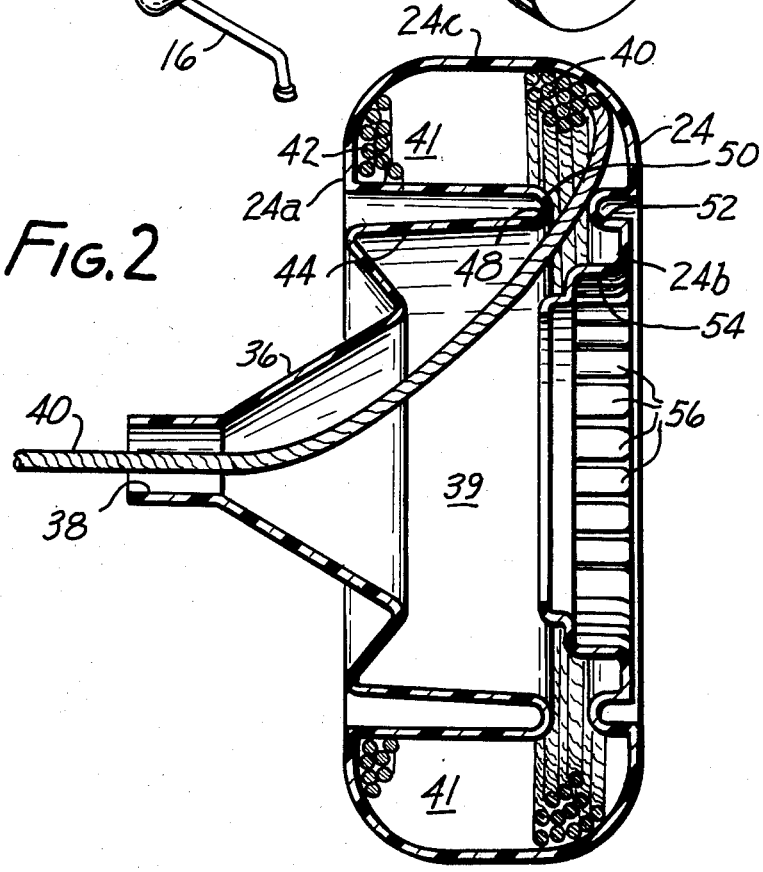
FIG. 2 is an enlarged cross-section view of the storage drum illustrating the configuration of the restricted volume snake storage portion and the guide passageway leading thereto.

Referring also to FIG. 2, in this embodiment of the invention the drum 24 comprises a front wall **24*a*, a rear wall 24*b* and a curved outer peripheral portion 24*c*. Also forming a part of drum 24 is a generally frustoconically shaped forward guide portion 36 which is provided with an opening 38 adapted to accommodate passage of a coil spring 40 which is adapted to be stored in a coiled configuration within drum 24. Snake 40** is typically formed of helically wound spring wire and is manufactured in various diameters typically ranging from $\frac{3}{8}$ to $\frac{3}{4}$ of an inch.

An important aspect of the present invention is the drain partition means which partitions the hollow interior of the drain into a first portion 39 which communicates with guide portion 36 and a second spring storage portion 41. In the embodiment of the invention shown in FIG. 2 the partition means comprises a pair of spaced apart wall portions 42 and 44 which extend inwardly from front wall **24*a* of drum 24. As indicated by FIG. 2, wall portions 42 and 44 are disposed radially inwardly of peripheral portion 24*c* of drain 24 and cooperate therewith to define the spring storage portion or compartment 41. Compartment 41 is generally annular in shape and is of a restricted volume adapted to closely contain the coils of spring or snake 40 in the manner shown in FIG. 2. As previously mentioned, the volume of compartment 41 can be increased or decreased during the fabrication of the drum by forming wall portions 42 and 44** radially inwardly or outwardly so as to accommodate snakes of larger or smaller diameter.

Wall portions 42 and 44 are interconnected at their inner extremities by an end wall portion 48 which is spaced apart from rear wall **24*b*, a limited distance so as to define a guide passageway 50 for guiding passage of the snake 40 between the spring storage portion 41 and the forward guide portion or opening 38. During fabrication of the drum guide passageway 50** can be made larger or smaller to accommodate the use of snakes of varying diameter.

As indicated in FIG. 2, rear wall **24*b* includes an inwardly projecting circumferentially extending bead-like protuberance 52, which cooperates with end wall 48 to define passageway 50. While passageway 50 may be constructed in various sizes depending upon the end application to be made of the tool and the size snake to be used, opening 50 is preferably formed to be of a size less than four times the diameter of the plumber's snake being used. By thus limiting the size of passageway 50, backlooping and kinking of the snake 40 within the storage compartment 41** is effectively precluded.

Rear wall **24*b* is provided with an opening 54 which is coaxially aligned with opening 38 of the drum. Provided internally of opening 54 are a plurality of circumferentially spaced teeth 56. Teeth 56 are spaced apart so as to closely receive driving teeth 34 of member 32 so that upon rotation of stub shaft 28 driving teeth 34 will controllably rotate drum 24 and also snake 40** which is contained within the drum.

Affixed to U-shaped member 14 at its forward extremity, is a hinge bearing 60 which, when in a closed position as shown in FIG. 1, rotatably supports the forward portion of drum 24 and holds the drum in coaxial alignment with stub shaft 28. The longitudinal spacing of bearing 60 from drive member 32 is such that drum 40 will always be maintained within the supporting frame so that drive teeth 34 of member 32 are in complete engagement with the driven teeth 56 formed about opening 54 in the rear wall of the drum.

With drum 24 mounted within frame 12 in driving engagement with the drive means, actuation of motor 26 will cause rotation of stub shaft 28 and in turn rotation of member 32. Rotation of member 32 and drive teeth 34 will cause rotation of drum 24, the forward portion of which is rotatably supported within bearing 60. Upon rotation of drum 24 and the snake 40, which is coiled therewithin, rectilinear feed of snake 40 can be accomplished by hand or by mechanical feed means of various design. These feed means are adapted to closely receive the snake as it passes forwardly of the drum housing and to releasably grip the snake in a manner to urge axial or rectilinear movement thereof. These feed means, which means forms no part of the present invention, may take on several forms, as for example that depicted in U.S. Pat. No. 3,958,293, issued to the present inventor, or, alternatively that depicted in the patent to Hunt, U.S. Pat. No. 3,095,592.

So long as the drum 24 is rotated by the drive means and so long as the feed means is in driving engagement with the snake, the snake will move rectilinearly with respect to opening 38 in drum 24. If the drum is rotated in a first direction, the snake will be paid out from the drum. Conversely, if the drum is rotated in a second, reverse direction the snake will be retracted through opening 38 for coiling within the storage portion or compartment 41.

So long as the snake 40 is free to move forwardly through the wasteline being cleaned without restriction, no torque will be built up within the snake. However, should the snake encounter an obstruction which precludes its continued rotation or forward movement, substantial torque forces will be built up in the snake tending to cause it to backloop and kink within drum 40. In many prior art cleanout machines this torque buildup would cause the snake 40 to whip and frequently to become severely tangled within the storage drum. This whipping and backlooping is very hazardous and oftentimes resulted in damage to the snake.

Once this backlooping and tangling occurs, the operator is required to stop the machine, withdraw a portion of the snake from the pipe being cleaned, and then attempt to relieve the backlooping in the snake. This procedure is often difficult and time consuming. However, due to the unique design of the drum of the present invention, this tangling of the snake within the storage compartment of the drum is effectively precluded. Because of the limited volume of the snake storage compartment 41, and due to the unique size and location of the guide passageway 50, it is impossible for the snake to backloop and kink within the storage compartment. Rather, any tendency of the snake to backloop will always occur within the forward portion of the drum which is easily accessible through rear opening 54. Accordingly, with the apparatus of the present invention, should the snake encounter an obstruction which causes a torque buildup, any backlooping of the snake will occur only within the forward central portion 39 of the drum. In such a situation, all the operator need do is release bearing 60, lift drum 24 from the frame and reach into the central portion of the drum through opening 54 to readily and expeditiously relieve any backlooping of the snake which may have occurred. Once this is done, the drum 24 can be quickly remounted within frame 12 and the pipe cleaning operation can once again continue.

Should the job at hand require the use of a heavier or lighter snake, the construction of the apparatus readily permits removal of drum 24 and replacement thereof with a drum containing the desired size snake and having a compartment 41 and a guide passageway 50 or optimum size to accommodate the particular snake.

Figure 3:
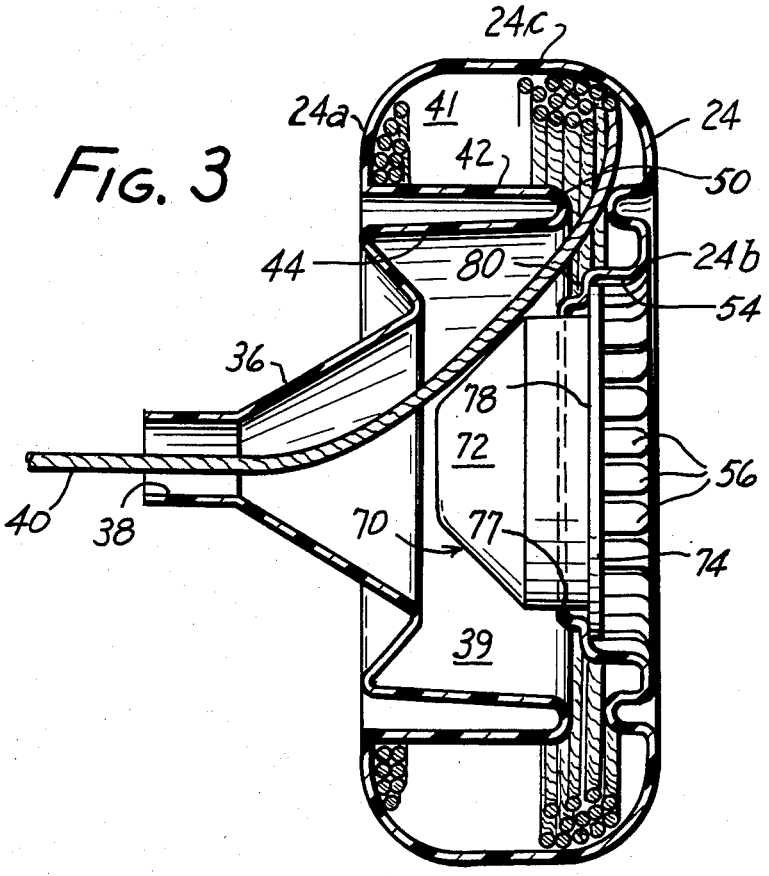
FIG. 3 is a cross-section view similar to FIG. 2 but showing an alternate embodiment of the invention wherein a guide hub is removably carried within the drum.
Figure 4:
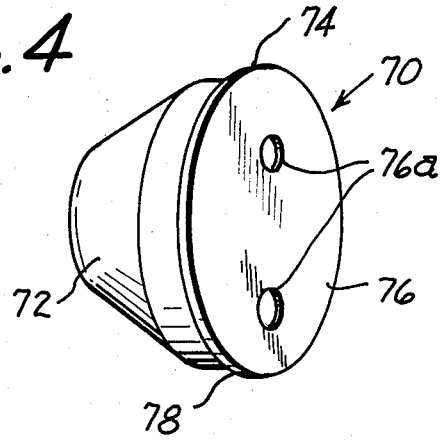
FIG. 4 is a generally perspective view of the guide hub shown in FIG. 3.

Turning now to FIGS. 3 and 4 an alternate form of the invention is there shown. In this form of the invention the drum 24 is of identical construction to that shown in FIG. 1 and previously described herein. Therefore, like numerals are used in FIG. 3 to identify like component parts of the drum.

Added to the embodiment of the invention shown in FIG. 3 is a removable guide hub or member 70. Hub 70 is provided with a dome shaped forward portion 72 and a rear flange portion 74. Formed within the rear face 76 of the hub is a pair of spaced apart apertures **76*a* (FIG. 4). Hub 70 is sized so that forward portion 72 is closely receivable within opening 77 formed in the rear wall 24*b* of the drum. However, flange portion 74 is of a slightly larger diameter so that the forward face thereof 70 will engage a stepped wall portion 80 formed on drum 24. When the drum is mounted on the drive assembly 30, shown in FIG. 1, drive teeth 34 will engage the hub 70 and hold it firmly in the position shown in FIG. 3 with the forward face 78 of the flange 74 held in pressural engagement with stepped wall portion 80 of drum 24**.

The function of the guide hub 70 is to reduce the size of compartment 39 while at the same time serving to guide snake 40 through passageway 50 into compartment 41. The guide hub thus serves to reduce further the possibility of tangling of the snake within the drum particularly where a smaller diameter snake is used in the sewer clean out operation.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A pipe cleaning machine of the type characterized by having an elongated flexible plumbers snake, or spring, formed of helically wound spring wire which is stored within the machine in a coiled configuration and can be withdrawn forwardly of the machine for insertion in to the pipe to be cleaned, comprising:

(a) a frame;

(b) a one-piece integrally formed, molded drum rotatably mounted on said frame including:

(1) a front wall;

(2) a rear wall;

(3) a curved peripheral portion;

(4) a generally frustoconically shaped forward guide portion adapted to accommodate passage of the spring therethrough; and (5) a pair of spaced apart wall portions integrally formed with and extending inwardly from said front wall, said wall portions being disposed radially inwardly of said peripheral portion and cooperating therewith to define a substantially closed spring storage portion, said wall portions being interconnected by an end wall portion spaced from said rear wall a limited distance to define a guide passageway of a predetermined limited size for guiding passage of the snake between said spring storage portion and said forward guide portion; and (c) drive means for rotating said drum.

2. A pipe cleaning machine as defined in claim 1 in which said rear wall is provided with an opening which is coaxially aligned with said forward guide portion, said opening in said rear wall being provided with a plurality of circumferentially spaced teeth.

3. A pipe cleanout machine, as defined in claim 2 in which said drive means comprises a rotatable drive member carried by said frame, said drive member having drive teeth adapted to drivably engage said spaced teeth of said drum.

4. A pipe cleaning machine of the type characterized by having an elongated flexible plumbers snake, or spring, formed of helically wound spring wire which is stored within the machine in a coiled configuration and can be withdrawn forwardly of the machine for insertion in to the pipe to be cleaned, comprising:

(a) a one-piece integrally molded, rotatably drum having a hollow interior portion and including:

(1) a front wall;

(2) a rear wall;

(3) a curved peripheral portion;

(4) a generally frustoconically shaped forward guide portion adapted to accommodate passage of the spring therethrough; and (b) a partition means integrally formed with said front wall extending inwardly of said drum from partitioning said hollow interior portion thereof into a first portion communicating with said forward guide portion and a substantially closed second storage portion, said partition means being spaced from said rear wall to define a guide passageof predetermined size way for guiding passage of the snake between said spring storage portion and said forward guide portion.

5. A pipe cleaning machine as defined in claim 4 in which said partition means comprises a pair of spaced walls extending inwardly from said front wall of said drum.

6. A pipe cleaning machine as defined in claim 4 including a hub member removably positioned within said interior portion of said drum, said member having a dome shaped forward portion adapted to guidably engage the snake.

7. A pipe cleaning machine of the type characterized by having an elongated flexible plumbers snake, or spring, formed by helically wound spring wire which is stored within the machine in a coiled configuration and can be withdrawn forwardly of the machine for insertion into the pipe to be cleaned, comprising:

(a) an integrally formed, one piece rotatable drum, including:

(1) a rear wall having an opening therein;

(2) an annular shaped, exteriorly closed spring storage portion for closely containing the spring in a coiled configuration;

(3) a forward portion, including an opening adapted to accommodate passage of the spring therethrough; and (4) an inwardly extending wall portion disposed intermediate said spring storage portion and said forward portion, said inwardly extending wall portion terminating in an end portion spaced from said rear wall a limited distance to define a guide passageway for guiding passage of the spring between said storage portion and said opening in said forward portion;

(c) drive means for rotating said drum; and (d) a guide hub removably carried within the opening in said rear wall of said drum, said guide hub having a forward dome shaped portion extending inwardly from said rear wall.

* * * * *